US008022638B2

(12) United States Patent
Jang et al.

(10) Patent No.: US 8,022,638 B2
(45) Date of Patent: Sep. 20, 2011

(54) LCD BACKLIGHT INVERTER

(75) Inventors: Yu Jin Jang, Gyunggi-do (KR); Byoung Own Min, Gyunggi-do (KR); Jung Chul Gong, Seoul (KR); Sang Cheol Shin, Gyunggi-do (KR); Jeong In Cheon, Seoul (KR)

(73) Assignee: Samsung Electro-Mechanics Co., Ltd., Gyunggi-do (KR)

( * ) Notice: Subject to any disclaimer, the term of this patent is extended or adjusted under 35 U.S.C. 154(b) by 323 days.

(21) Appl. No.: 12/437,692

(22) Filed: May 8, 2009

(65) Prior Publication Data

US 2010/0109547 A1 May 6, 2010

(30) Foreign Application Priority Data

Oct. 30, 2008 (KR) ..... 10-2008-0107250

(51) Int. Cl.
*H05B 41/292* (2006.01)

(52) U.S. Cl. ..... 315/257; 315/299

(58) Field of Classification Search ..... 315/250, 315/254, 257, 291, 294, 297, 299, 307; 345/102
See application file for complete search history.

(56) References Cited

U.S. PATENT DOCUMENTS

| | | | | |
|---|---|---|---|---|
| 7,394,209 | B2 | 7/2008 | Lin et al. | |
| 7,411,354 | B2 * | 8/2008 | Hsu et al. | 315/169.3 |
| 7,554,273 | B2 * | 6/2009 | Lin et al. | 315/307 |
| 7,830,100 | B2 * | 11/2010 | Mi et al. | 315/291 |
| 2010/0181920 | A1 * | 7/2010 | Lee et al. | 315/121 |
| 2010/0201283 | A1 * | 8/2010 | Kawata et al. | 315/287 |
| 2010/0315005 | A1 * | 12/2010 | Lin et al. | 315/119 |

* cited by examiner

*Primary Examiner* — Don Le
(74) *Attorney, Agent, or Firm* — Lowe, Hauptman, Ham & Berner, LLP

(57) ABSTRACT

Disclosed is a liquid crystal display (LCD) backlight inverter. The LCD backlight inverter includes a lamp open detection unit outputting a first open detection voltage for a preset time period when it is determined that a predetermined lamp is open, based on a current voltage corresponding to the current of the predetermined lamp of a plurality of lamps, a first open determination unit outputting an open detection signal when the first open detection voltage is input, a second open determination unit outputting a protection signal when it is determined that all of the plurality of lamps are open based on detection voltages of the plurality of lamps, a temporary protection determination unit outputting a frequency change signal when both the open detection signal and the protection signal are input, and an operating frequency control unit changing an operating frequency to a preset protective frequency according to the frequency change.

12 Claims, 2 Drawing Sheets

LCD BACKLIGHT INVERTER

CROSS-REFERENCE TO RELATED APPLICATIONS

This application claims the priority of Korean Patent Application No. 2008-0107250 filed on Oct. 30, 2008, in the Korean Intellectual Property Office, the disclosure of which is incorporated herein by reference.

BACKGROUND OF THE INVENTION

1. Field of the Invention

The present invention relates to an inverter for driving lamps used for a backlight unit of a liquid crystal display (LCD), and more particularly, to an LCD backlight inverter, which can perform a protection operation by monitoring the state where all lamps are separated from their respective lamp connectors (hereinafter, also referred to as "All Lamp Connectors Open"), thereby preventing damage to internal components and circuits, including the lamps.

2. Description of the Related Art

In general, liquid crystal displays (LCDs) include backlights. The backlights may illuminate the LCD from the back of a display panel, which is unable to emit light by itself. Cold cathode fluorescent lamps (CCFLs) have been in common use in backlights for large LCDs, and require the use of an inverter for the operation thereof.

Maintaining even LCD lighting is a critical factor in the driving of the backlight lamps. To this end, the inverter employs a circuit that feeds back the current of the lamp in order to achieve constant lamp current. In addition, the inverter also includes an over-voltage protection circuit that serves to protect the lamps and the inverter circuit when excessive voltage is applied thereto.

The function as a protective circuit is very important for the inverter that drives the LCD backlight unit. Particularly, protecting devices upon the detection of an open lamp is one of the main functions of an inverter that drives multiple lamps.

The related art LCD backlight inverter employs a configuration that detects operating voltages of opposite phases being applied to a plurality of lamps. Thus, the inverter detects the opening, that is, the separation of some of a plurality of lamps by detecting the voltage resulting from unbalanced operating voltages occurring when some of the plurality of lamps are open, thereby performing a protective operation.

However, the related art LCD backlight inverter fails to recognize the state where all of the lamps are open (i.e., All Lamp Connectors Open) because unbalanced operating voltages are not generated in this state. For this reason, while no protective operation is enabled, the inverter performs a control operation to increase the operating current, which is currently at a low level due to the state of All Lamp Connectors Open. Consequently, the operating voltage is applied with a low switching frequency, damaging internal components and circuits, including the lamps.

SUMMARY OF THE INVENTION

An aspect of the present invention provides an LCD backlight inverter capable of performing a protective operation in an LCD backlight unit by monitoring All Lamp Connectors Open in order to prevent damage to circuits and internal components, including lamps.

According to an aspect of the present invention, there is provided a liquid crystal display (LCD) backlight inverter including: a lamp open detection unit outputting a first open detection voltage for a preset time period when it is determined that a predetermined lamp is open, based on a current voltage corresponding to a current of the predetermined lamp of a plurality of lamps, and outputting a normal voltage after the preset time period; a first open determination unit outputting an open detection signal when the first open detection voltage is input from the lamp open detection unit; a second open determination unit outputting a protection signal when it is determined that all of the plurality of lamps are open based on a second open detection voltage input via a common node connected in common to respective detection voltage terminals of the plurality of lamps; a temporary protection determination unit outputting a frequency change signal when both the open detection signal and the protection signal are input from the first open determination unit and the second open determination unit respectively; and an operating frequency control unit changing an operating frequency to a preset protective frequency according to the frequency change signal from the temporary protection determination unit.

The lamp open detection unit may include: a first diode turned on if the current voltage is higher than a turn-on voltage, and turned off if the current voltage is lower than the turn-on voltage; a current source connected between a cathode of the first diode and a power terminal; a capacitor connected between the cathode of the first diode and the ground, the capacitor being charged with a current from the current source when the first diode is turned off to supply the first open detection voltage for the preset time period and supply a normal voltage after the preset time period elapses; and a resistor connected between the current source and the ground and forming a current path.

The first open determination unit may include a first comparator including an inverting input terminal receiving the first open detection voltage from the lamp open detection unit, a non-inverting input terminal receiving a preset first set voltage, and an output terminal comparing the first open detection voltage from the lamp open detection unit with the first set voltage and outputting the open detection signal if the first open detection voltage from the lamp open detection unit is higher than the first set voltage.

The second open determination unit may include a second comparator including a non-inverting input terminal receiving the second open detection voltage, an inverting input terminal receiving a preset second set voltage, and an output terminal comparing the second open detection voltage with the second set voltage and outputting the protection signal if the second open detection voltage is higher than the second set voltage.

The temporary protection determination unit may include an OR gate performing an OR operation on the open detection signal from the first open determination unit and the protection signal from the second open determination unit.

The operating frequency control unit may include: a frequency setting part setting an operating frequency to a preset protective frequency when the frequency change signal is input from the temporary protection determination unit, the protective frequency being set to be higher than a normal operating frequency; and a main oscillator generating a sine wave signal having the protective frequency set by the frequency setting part.

The LCD backlight inverter may further include: a main detection unit detecting a voltage corresponding to the operating current supplied to each of the plurality of lamps and outputting operating voltages of opposite phases of different lamp among the plurality of lamps, and outputting the second open detection voltage input via the common node connected in common to the respective detection voltage terminals of the plurality of lamps; a voltage detection unit adding the operating voltages of opposite phases and outputting a first detection voltage; and a current detection unit detecting the predetermined lamp of each of the plurality of lamps to convert the detected current into the current voltage.

The LCD backlight inverter may further include: a feedback selection unit outputting a current selection signal if the first detection voltage is lower than a preset first reference voltage, and outputting a voltage selection signal if the first detection voltage is higher than the first reference voltage; a first error amplification unit operating when the current selection signal is output from the feedback selection unit, comparing the current voltage with a preset second reference voltage, and outputting a first error voltage corresponding to a difference between the current voltage and the second reference voltage; and a second error amplification unit operating when the voltage selection signal is output from the feedback selection unit, comparing the second open detection voltage with a preset third reference voltage, and outputting a second error voltage corresponding to a difference between the second open detection voltage and the third reference voltage.

The current selection signal may include a first switching signal having a level for enabling a current feedback operation, and a second switching signal having a level for disabling a voltage feedback operation, and the voltage selection signal may include a first switching signal having a level for disabling a current feedback operation, and a second switching signal having a level for enabling a voltage feedback operation.

The feedback selection unit may include: a determiner outputting the current selection signal if the first detection voltage is lower than the first reference voltage, and outputting the voltage selection signal if the first detection voltage is higher than the first reference voltage; a first switch connected between an inverting input terminal of the first error amplification unit and the ground, and switched off by the current selection signal or switched on by the voltage selection signal; and a second switch connected between an inverting input terminal of the second error amplification unit and the ground, and switched off by the current selection signal or switched on by the voltage selection signal.

The LCD backlight inverter may further include a main switching signal generation unit comparing one of the first and second error voltages with the sine wave signal from the operating frequency control unit, and generating a main switching signal having a pulse with a duty determined according to a result of the comparison.

The LCD backlight inverter may further include a system protection control unit outputting a system shutdown signal after the preset time period elapses when the protection signal is input from the second open determination unit.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
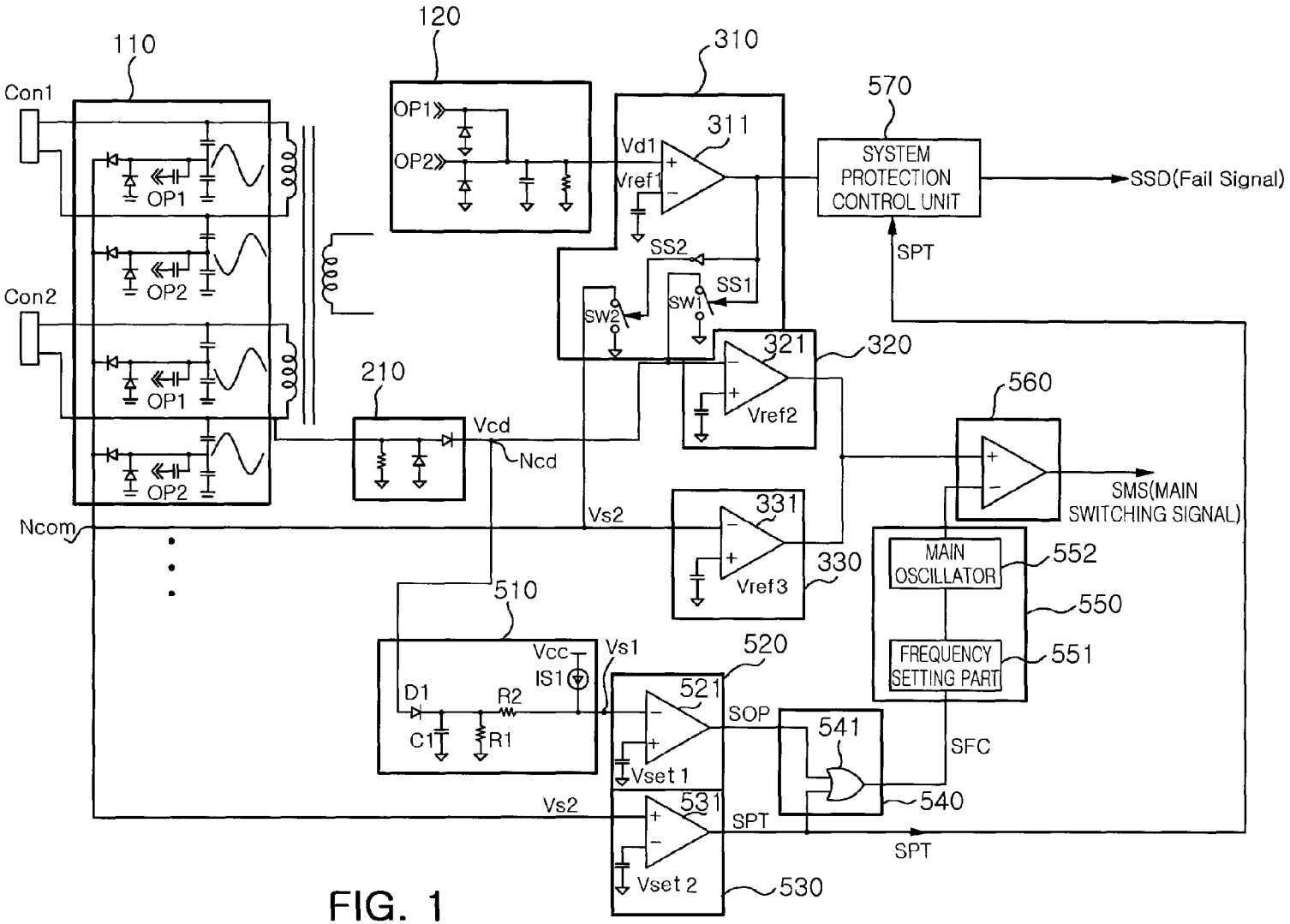
FIG. 1 is a block diagram of an LCD backlight inverter according to an exemplary embodiment of the present invention.

Exemplary embodiments of the present invention will now be described in detail with reference to the accompanying drawings.

The invention may, however, be embodied in many different forms and should not be construed as being limited to the embodiments set forth herein; rather, these embodiments are provided so that this disclosure will be thorough and complete, and will fully convey the concept of the invention to those skilled in the art. Like reference numerals in the drawings denote like elements.

FIG. 1 is a block diagram of an LCD backlight inverter according to an exemplary embodiment of the present invention. Referring to FIG. 1, the LCD backlight inverter, according to this embodiment, includes a lamp open detection unit 510, a first open determination unit 520, a second open determination unit 530, a temporary protection determination unit 540, and an operating frequency control unit 550.

If Lamp Connector Open is detected, based on a current voltage Vcd corresponding to the current of a predetermined lamp of a plurality of lamps, the lamp open detection unit 510 outputs a first open detection voltage Vs1 for a preset time period ΔT, and after the preset time period, outputs normal voltage. Here, Lamp Connector Open refers to the state in which the predetermined lamp is separated from a lamp connector, that is, the lamp is open.

If the first open detection voltage Vs1 is input from the lamp open detection unit 510, the first open determination unit 520 outputs an open detection signal SOP.

The second open determination unit 530 determines that all the lamps are open (hereinafter, also referred to as All Lamp Connectors Open) based on a second open detection voltage Vs2 input via a common node Ncom connected in common to respective detection voltage terminals of the plurality of lamps, and outputs a protection signal SPT.

The temporary protection determination unit 540 outputs a frequency change signal SFC when both the open detection signal SOP and the protection signal SPT are input from the first open determination unit 520 and the second open determination unit 530, respectively.

The operating frequency control unit 550 changes the operating frequency to a preset protective frequency according to the frequency change signal SFC from the temporary protection determination unit 540.

The lamp open detection unit 510 includes a first diode D1, a current source IS1, a capacitor C1, and resistors R1 and R2. The first diode D1 is turned on when the current voltage Vcd is higher than a turn-on voltage, and turned off when the current voltage Vcd is lower than the turn-on voltage. The current source IS1 is connected between a cathode of the first diode D1 and a power terminal. The capacitor C1 is connected between the cathode of the first diode D1 and the ground, and is charged with the current from the current source when the first diode D1 is turned off, to supply the first open detection voltage Vs1 for the preset time period and supply normal voltage after the preset time period. The resistors R1 and R2 are connected between the current source IS1 and the ground, forming a current path.

The first open determination unit 520 may include a first comparator 521 having an inverting input terminal, a non-inverting input terminal, and an output terminal. The inverting input terminal receives the first open detection voltage Vs1 from the lamp open detection unit 510, and the non-inverting input terminal receives a preset first set voltage Vset1. The output terminal compares the first set voltage Vset1 with the first open detection voltage Vs1 from the lamp open detection unit 510 to output the open detection signal SOP if the first open detection voltage Vs1 is higher than the first set voltage Vset1.

The second open determination unit 530 may include a second comparator 531 including a non-inverting input terminal, an inverting input terminal, and an output terminal. The non-inverting input terminal receives the second open detection voltage Vs2, and the inverting input terminal receives a preset second set voltage Vset2. The output terminal compares the second set voltage Vset2 with the second open detection voltage Vs2, and outputs the protection signal SPT when the second open detection voltage Vs2 is higher than the second set voltage Vset2.

The temporary protection determination unit 540 may include an OR gate to perform a logic OR operation on the open detection signal SOP from the first open determination unit 520 and the protection signal SPT from the second open determination unit 530.

The operating frequency control unit 550 includes a frequency setting part 551 and a main oscillator 552. The frequency setting part 551 sets an operating frequency to a preset protection frequency when the frequency change signal SFC is input from the temporary protection determination unit 540. Here, the protection frequency is set to be higher than the normal operating frequency. The main oscillator 552 generates a sine wave signal having the protection frequency set by the frequency setting part 551.

The LCD backlight inverter, according to this embodiment, may further include a main detection unit 110, a voltage detection unit 120 and a current detection unit 210.

The main detection unit 110 detects a voltage corresponding to the operating current supplied to each of the plurality of lamps, and outputs the operating voltages OP1 and OP2 of opposite phases of different lamps among the plurality of lamps. Also, the main detection unit 110 outputs the second open detection voltage Vs2 input via the common node Ncom connected in common to the respective detection voltage terminals of the plurality of lamps.

The voltage detection unit 120 adds up the operating voltages of opposite phases OP1 and OP2 to output a first detection voltage Vd1.

The current detection unit 210 detects the current of the predetermined lamp of the plurality of lamps, and converts the current into the current voltage Vcd.

The LCD backlight inverter, according to this embodiment, may further include a feedback selection unit 310, a first error amplification unit 320 and a second error amplification unit 330.

The feedback selection unit 310 outputs a current selection signal if the first detection voltage Vd1 is lower than a preset first reference voltage Vref1. If the first detection voltage Vd1 is higher than the first reference voltage Vref1, the feedback selection unit 310 outputs a voltage selection signal.

The current selection signal includes a first switching signal SS1 having a level for enabling a current feedback operation, and a second switching signal SS2 having a level for disabling a voltage feedback operation. Unlike the current selection signal, the voltage selection signal includes a first switching signal SS1 having a level for disabling the current feedback operation, and a second switching signal SS2 having a level for enabling the voltage feedback operation.

The feedback selection unit 310 includes a determiner 311, a first switch SW1, and a second switch SW2. The determiner 311 outputs the current selection signal if the first detection voltage Vd1 is lower than the preset first reference voltage Vref1, and outputs the voltage selection signal if the first detection voltage Vd1 is higher than the first reference voltage Vref1. The first switch SW1 is connected between an inverting input terminal of the first error amplification unit 320 and the ground, and is switched off by the current selection signal or switched on by the voltage selection signal. The second switch SW2 is connected between an inverting input terminal of the second error amplification unit 330 and the ground, and is switched off by the current selection signal or switched on by the voltage selection signal.

The first error amplification unit 320 operates when the current selection signal is input from the feedback selection unit 310. The first error amplification unit 320 compares a preset second reference voltage Verf2 with the current voltage Vcd, and outputs a first error voltage corresponding to the difference therebetween.

The second error amplification unit 330 operates when the voltage selection signal is input from the feedback selection unit 310. The second error amplification unit 330 compares a preset third reference voltage Vref3 with the second open detection voltage Vs2, and outputs a second error voltage corresponding to the difference therebetween.

The LCD backlight inverter, according to this embodiment, may further include a main switching signal generation unit 560, and a system protection control unit 570.

The main switching signal generation unit 560 compares the sine wave signal from the operating frequency control unit 550 with one of the first and second error voltages, and generates a main switching signal SMS having a pulse with a duty determined based on the comparison result.

When the protection signal SPT is input from the second open determination unit 530, the system protection control unit 570 outputs a system shutdown signal SSD after the set time elapses.

Figure 2:
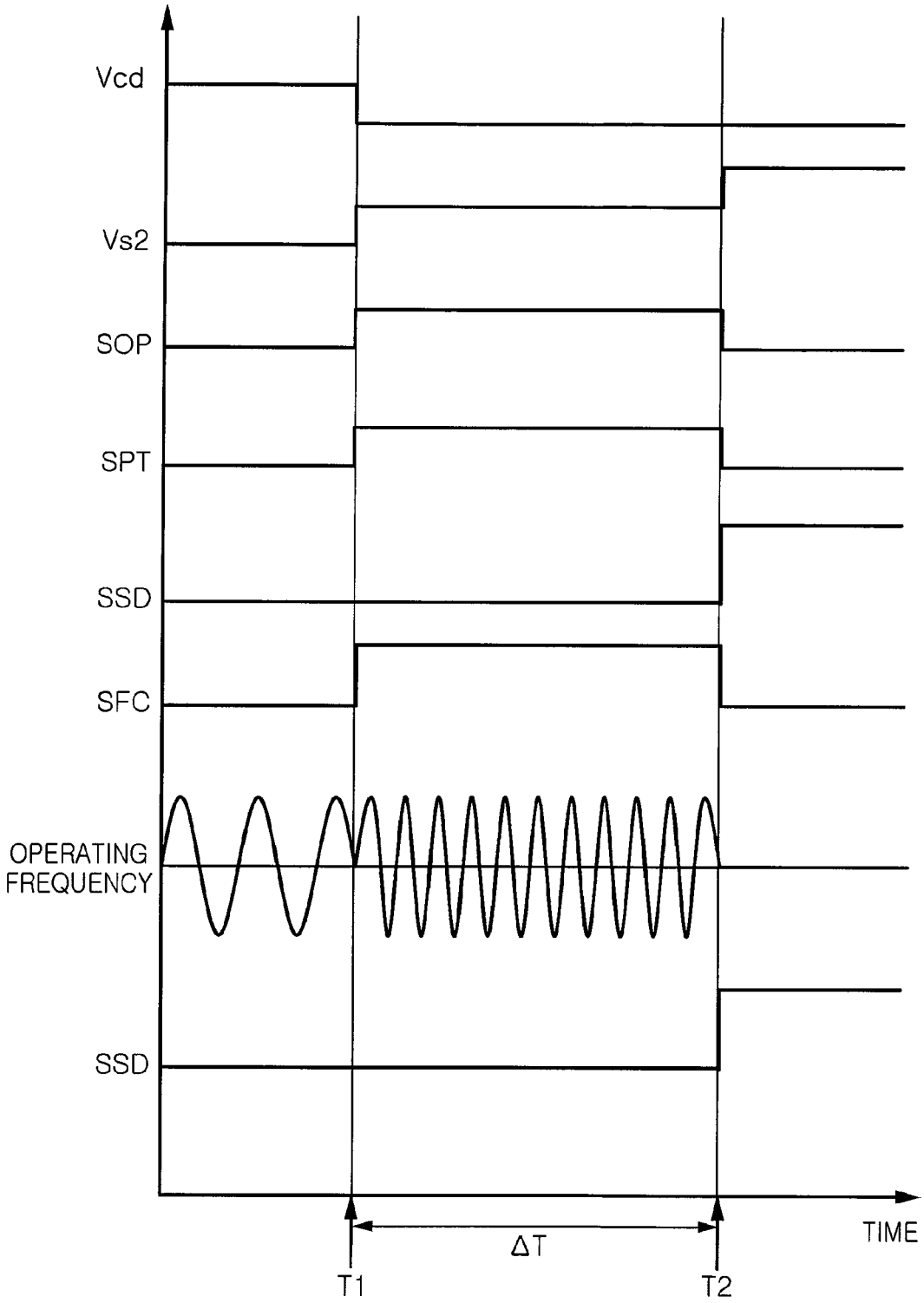
FIG. 2 is a timing chart of the main signals of an LCD backlight inverter according to an exemplary embodiment of the present invention.

FIG. 2 is a timing chart showing the signals of the LCD backlight inverter of FIG. 1. In FIG. 2, Vcd denotes a voltage detected by the current detection unit 210 and corresponding to the current of a predetermined lamp of the plurality of lamps. Vs2 denotes a voltage detected by the main detection unit 110 and output through the common node Ncom connected in common to the respective detection voltage terminals of the plurality of lamps. SOP denotes a signal output from the first open determination unit 520 and indicating Lamp Connector Open in the case that the first open detection voltage Vs1 is input from the lamp open detection unit 510. SPT denotes a signal output from the second open determination unit 530 when All Lamp Connectors Open is determined based on the second open detection voltage Vs2. SFC denotes a frequency change signal output from the temporary protection determination unit 540 and generated in the case that both the open detection signal SOP and the protection signal SPT are input from the first open determination unit 520 and the second open determination unit 530 respectively. SSD denotes a system shutdown signal output from the system protection control unit 570 after the preset time period in the case that the protection signal SPT is input from the second open determination unit 530.

It can be seen from FIG. 2 that the operating frequency is set to be a low frequency before the time point T1 when All Lamp Connectors Open is detected, and is set to a relatively high protective frequency during the preset time period ΔT from the time point T1 of detecting All Lamp Connectors Open to the time point T2.

Hereinafter, the operations and effects of the present invention will be described in more detail, with reference to the accompanying drawings.

Referring to FIGS. 1 and 2, the LCD backlight inverter, according to the present invention, will now be described. Referring to FIG. 1, the LCD backlight inverter, according to this embodiment, includes the main detection unit 110, the voltage detection unit 120, and the current detection unit 210 in order to detect the operating currents and the operating voltages for a plurality of lamps. Also, the LCD backlight inverter includes the feedback selection unit 310, the first error amplification unit 320, and the second error amplification unit 330 in order to select a feedback operation based on the states of the lamps.

The main detection unit 110 detects a voltage corresponding to the operating current supplied to each of the plurality of lamps and outputs operating voltages OP1 and OP2 of opposite phases (hereinafter, also referred to as 'opposite-phase operating voltages OP1 and OP2') of different lamps among the plurality of lamps. Also, the main detection unit 110 outputs the second open detection voltage Vs2 input via the common node Ncom connected in common to the respective detection voltage terminals of the plurality of lamps.

The voltage detection unit 120 adds up the opposite-phase operating voltages OP1 and OP2 to output the first detection voltage Vd1. The first detection voltage Vd1 has a magnitude of about zero because normal opposite-phase operating voltages OP1 and OP2 cancel each other. If any one of the plurality of lamps is open, the first detection voltage Vd1 has a predetermined magnitude, which is not zero.

The feedback selection unit 310 outputs a current selection signal if the first detection voltage Vd1 is lower than a preset first reference voltage Vref1, while outputting a voltage selection signal if the first detection voltage Vd1 is higher than the first reference voltage Vref1. Here, the first reference voltage Vref1 is set to a voltage with which it can be determined whether the first detection voltage Vd1 is zero or higher.

For a more detailed example, the current selection signal includes a first switching signal SS1 having a level for enabling the current feedback operation, and a second switching signal SS2 having a level for disabling the voltage feedback operation. The voltage selection signal includes a first switching signal having a level for disabling the current feedback operation, and a second switching signal SS2 having a level for enabling the voltage feedback operation.

A determiner 311 of the feedback selection unit 310 outputs the current selection signal if the first detection voltage Vd1 is lower than the preset first reference voltage Vref1, and outputs the voltage selection signal if the first detection voltage Vd1 is higher than the first reference voltage Vref1.

The first switch SW1 of the feedback selection unit 310 is switched off by the current selection signal, causing the first error amplification unit 32 to operate normally. The first switch SW1 is switched off by the voltage selection signal to cause the first error amplification 320 to not operate.

The second switch SW2 of the feedback selection unit 310 is switched off by the voltage selection signal to cause the second error amplification unit 330 to operate normally. The second switch SW2 is switched on by the current selection signal to cause the second error amplification unit 330 to not operate.

Accordingly, when the current selection signal is output from the feedback selection unit 310, the first error amplification unit 320 operates to compare the current voltage Vcd with a preset second reference voltage Vref2, and outputs a first error voltage corresponding to the difference therebetween. Here, the second reference voltage Vref2 is set to a voltage corresponding to a desired operating current.

When the voltage selection signal is output from the feedback selection unit 310, the second error amplification unit 330 operates to compare the second open detection voltage Vs2 with a preset third reference voltage Vref3, and outputs a second error voltage corresponding to the difference therebetween. Here, the third reference voltage Vref3 is set to a voltage with which it can be determined whether the operating voltage is normal or abnormal.

The LCD backlight inverter, according to this embodiment, includes the lamp open detection unit 510, the first open determination unit 520, the second open determination unit 530, the temporary protection determination unit 540, and the operating frequency control unit 550 to stably shut down the system while protecting internal components and circuits in the case of All Lamp Connectors Open.

Referring to FIG. 1, the lamp open detection unit 510 outputs the first open detection voltage Vs1 for a preset time period ΔT when Lamp Connector Open is detected based on the current voltage Vcd corresponding to the current of the predetermined lamp of the plurality of lamps. After the preset time period elapses, the lamp open detection unit 510 outputs normal voltage.

In more detail, if the current voltage Vcd is higher than a turn-on voltage, the first diode D1 of the lamp open detection unit 510 is turned on. The current voltage, having passed through the first diode D1, is supplied as normal voltage to the first open determination unit 520 via the first and second resistors R1 and R2.

In contrast, if the current voltage Vcd is lower than the turn-on voltage, the first diode D1 is turned off. When the first diode D1 is turned off, the first capacitor C1 is charged with the current from the current source IS1. The time for which the current is charged in the first capacitor C1 corresponds to the time period determined according to the respective time constants of the first capacitor C1 and the first and second resistors R1 and R2.

By the above operation, the first diode D1 is turned off, and thus the lamp open detection unit 510 supplies the first open detection voltage Vs1 for the preset time period and then supplies the normal voltage after the preset time period.

Referring to FIG. 1, the first open determination unit 520 outputs an open detection signal SOP when the first open detection voltage Vs1 is input from the lamp open detection unit 510.

Specifically, in the case that the first open determination unit 520 includes the first comparator 521 as shown in FIG. 1, the first comparator 521 compares the first open detection voltage Vs1, input from the lamp open detection unit 510 through the inverting input terminal, with the first set voltage Vset1, input through the non-inverting input terminal. If the first open detection voltage Vs1 from the lamp open detection unit 510 is higher than the first set voltage Vset1, the first comparator 521 outputs an open detection signal SOP.

Thereafter, referring to FIG. 1, the second open determination unit 530 determines All Lamp Connectors Open based on the second open detection voltage Vs2 input via the common node Ncom connected in common to the respective detection voltage terminals of the plurality of lamp, and outputs a protection signal SPT.

Specifically, in the case that the second open determination unit 530 includes the second comparator 531 as shown in FIG. 1, the second comparator 531 compares the second open detection voltage Vs2, input through the inverting input terminal, with the second set voltage Vset2, input through the non-inverting input terminal. If the second open detection voltage Vs2 is higher than the second set voltage Vset2, the second comparator 531 outputs the protection signal SPT.

Thereafter, the temporary protection determination unit 540 outputs a frequency change signal SFC when both the open detection signal SOP and the protection signal SPT are input from the first open determination unit 520 and the second open determination unit 530, respectively.

For example, in the case that the temporary protection determination unit 540 includes an OR gate 541 as shown in FIG. 1, the OR gate 541 performs an OR operation on the open detection signal SOP from the first open determination unit 520 and the protection signal SPT from the second open determination unit 530. Thus, the OR gate 541 outputs a logic low frequency change signal SFC when both of a logic low open detection signal SOP and a logic low protection signal SPT are input.

Thereafter, the operating frequency control unit 550 changes the operating frequency to a preset protective frequency based on the frequency change signal from the temporary protection determination unit 540.

For example, in the case that the operating frequency control unit 550 includes the frequency setting part 551 and the main oscillator 552, the frequency setting part 551 sets the frequency to a preset protective frequency when the frequency change signal is input from the temporary protection determination part 540. The protective frequency is set to be higher than the normal operating frequency. The main oscillator 552 generates a sine wave signal having the protective frequency set by the frequency setting part 551.

As shown in FIG. 2, the operating frequency set by the operating frequency control unit 550 may be set to a relatively low frequency until the time point T1 of detecting All Lamp Connectors Open, and set to a relatively high protective frequency during the preset time period ΔT from the time point T1 of detecting All Lamp Connectors Open to the time point T2.

Thereafter, in the case that the LCD backlight inverter, according to this embodiment, includes the main switching signal generation unit 560 and the system protection control unit 570, the main switching signal generation unit 560 compares the sine wave signal from the operating frequency control unit 550 with one of the first and second error voltages, and generates a main switching signal SMS having a pulse with a duty based on the comparison result.

When the protection signal SPT is input from the second open determination unit 530, the system protection control unit 570 outputs a system shutdown signal SSD after the preset time period.

According to the embodiments of the present invention as described above, when All Lamp Connectors Open is detected, that is, when it is detected that all the lamps are open, the switching frequency is increased immediately, so that damage to transformers, lamps and other components and circuits is prevented, and then the system is shut down after the preset time.

As set forth above, according to exemplary embodiments of the invention, the LCD backlight monitors All Lamp Connectors Open to perform a protective operation, thereby preventing damage to internal components and circuits, including the lamps.

While the present invention has been shown and described in connection with the exemplary embodiments, it will be apparent to those skilled in the art that modifications and variations can be made without departing from the spirit and scope of the invention as defined by the appended claims.

What is claimed is:

1. A liquid crystal display (LCD) backlight inverter comprising:

a lamp open detection unit outputting a first open detection voltage for a preset time period when it is determined that a predetermined lamp is open, based on a current voltage corresponding to a current of the predetermined lamp of a plurality of lamps, and outputting a normal voltage after the preset time period;

a first open determination unit outputting an open detection signal when the first open detection voltage is input from the lamp open detection unit;

a second open determination unit outputting a protection signal when it is determined that all of the plurality of lamps are open based on a second open detection voltage input via a common node connected in common to respective detection voltage terminals of the plurality of lamps;

a temporary protection determination unit outputting a frequency change signal when both the open detection signal and the protection signal are input from the first open determination unit and the second open determination unit respectively; and an operating frequency control unit changing an operating frequency to a preset protective frequency according to the frequency change signal from the temporary protection determination unit.

2. The LCD backlight inverter of claim 1, wherein the lamp open detection unit comprises:

a first diode turned on if the current voltage is higher than a turn-on voltage, and turned off if the current voltage is lower than the turn-on voltage;

a current source connected between a cathode of the first diode and a power terminal;

a capacitor connected between the cathode of the first diode and the ground, the capacitor being charged with a current from the current source when the first diode is turned off to supply the first open detection voltage for the preset time period and supply a normal voltage after the preset time period elapses; and a resistor connected between the current source and the ground and forming a current path.

3. The LCD backlight inverter of claim 2, wherein the first open determination unit comprises a first comparator including:

an inverting input terminal receiving the first open detection voltage from the lamp open detection unit;

a non-inverting input terminal receiving a preset first set voltage; and an output terminal comparing the first open detection voltage from the lamp open detection unit with the first set voltage and outputting the open detection signal if the first open detection voltage from the lamp open detection unit is higher than the first set voltage.

4. The LCD backlight inverter of claim 3, wherein the second open determination unit comprises a second comparator including:

a non-inverting input terminal receiving the second open detection voltage;

an inverting input terminal receiving a preset second set voltage; and an output terminal comparing the second open detection voltage with the second set voltage and outputting the protection signal if the second open detection voltage is higher than the second set voltage.

5. The LCD backlight inverter of claim 4, wherein the temporary protection determination unit comprises an OR gate performing an OR operation on the open detection signal from the first open determination unit and the protection signal from the second open determination unit.

6. The LCD backlight inverter of claim 5, wherein the operating frequency control unit comprises:

a frequency setting part setting an operating frequency to a preset protective frequency when the frequency change signal is input from the temporary protection determination unit, the protective frequency being set to be higher than a normal operating frequency; and a main oscillator generating a sine wave signal having the protective frequency set by the frequency setting part.

7. The LCD backlight inverter of claim 6, further comprising:

a main detection unit detecting a voltage corresponding to the operating current supplied to each of the plurality of lamps and outputting operating voltages of opposite phases of different lamp among the plurality of lamps, and outputting the second open detection voltage input via the common node connected in common to the respective detection voltage terminals of the plurality of lamps;

a voltage detection unit adding the operating voltages of opposite phases and outputting a first detection voltage; and a current detection unit detecting a current of the predetermined lamp of the plurality of lamps to convert the detected current into the current voltage.

8. The LCD backlight inverter of claim 7, further comprising:

a feedback selection unit outputting a current selection signal if the first detection voltage is lower than a preset first reference voltage, and outputting a voltage selection signal if the first detection voltage is higher than the first reference voltage;

a first error amplification unit operating when the current selection signal is output from the feedback selection unit, comparing the current voltage with a preset second reference voltage, and outputting a first error voltage corresponding to a difference between the current voltage and the second reference voltage; and a second error amplification unit operating when the voltage selection signal is output from the feedback selection unit, comparing the second open detection voltage with a preset third reference voltage, and outputting a second error voltage corresponding to a difference between the second open detection voltage and the third reference voltage.

9. The LCD backlight inverter of claim 8, wherein the current selection signal includes a first switching signal having a level for enabling a current feedback operation, and a second switching signal having a level for disabling a voltage feedback operation, and the voltage selection signal includes a first switching signal having a level for disabling a current feedback operation, and a second switching signal having a level for enabling a voltage feedback operation.

10. The LCD backlight inverter of claim 9, wherein the feedback selection unit comprises:

a determiner outputting the current selection signal if the first detection voltage is lower than the first reference voltage, and outputting the voltage selection signal if the first detection voltage is higher than the first reference voltage;

a first switch connected between an inverting input terminal of the first error amplification unit and the ground, and switched off by the current selection signal or switched on by the voltage selection signal; and a second switch connected between an inverting input terminal of the second error amplification unit and the ground, and switched off by the current selection signal or switched on by the voltage selection signal.

11. The LCD backlight inverter of claim 8, further comprising a main switching signal generation unit comparing one of the first and second error voltages with the sine wave signal from the operating frequency control unit, and generating a main switching signal having a pulse with a duty determined according to a result of the comparison.

12. The LCD backlight inverter of claim 8, further comprising a system protection control unit outputting a system shutdown signal after the preset time period elapses, when the protection signal is input from the second open determination unit.

* * * * *